US005415345A

United States Patent [19]

MacKinnon

[11] Patent Number: 5,415,345

[45] Date of Patent: May 16, 1995

[54] BOX WITH INTEGRAL CORNER REINFORCEMENTS

[75] Inventor: Robin MacKinnon, London, United Kingdom

[73] Assignee: FRA.MO. Snc Di Franca Riva & C, Voghera, Italy

[21] Appl. No.: 30,061

[22] PCT Filed: Sep. 3, 1991

[86] PCT No.: PCT/GB91/01491

§ 371 Date: May 13, 1993

§ 102(e) Date: May 13, 1993

[87] PCT Pub. No.: WO92/05076

PCT Pub. Date: Apr. 2, 1992

[30] Foreign Application Priority Data

Sep. 15, 1990 [GB] United Kingdom ..... 9020197

[51] Int. Cl.[6] ..... B65D 5/42

[52] U.S. Cl. ..... 229/191; 229/918; 229/919; 493/128; 493/168; 493/419; 493/460

[58] Field of Search ..... 229/191, 915, 918, 919; 493/121, 128, 141, 162, 167, 168, 419, 460, 461, 462

[56] References Cited

U.S. PATENT DOCUMENTS

| | | | |
|---|---|---|---|
| 2,665,836 | 1/1954 | Rendall | 229/191 |
| 2,801,740 | 8/1957 | Fallert . | |
| 3,034,698 | 5/1962 | Forrer | 229/191 |
| 3,978,774 | 9/1976 | Royal | 493/121 |
| 4,174,658 | 11/1979 | Graham | 493/162 |
| 4,581,005 | 4/1986 | Moen | 493/167 |
| 4,613,045 | 9/1986 | Watson | 229/191 |
| 5,285,956 | 2/1994 | Piepho | 229/191 |

FOREIGN PATENT DOCUMENTS

| | | | |
|---|---|---|---|
| 76883 | 4/1983 | European Pat. Off. | 229/191 |
| 538098 | 4/1993 | European Pat. Off. | 229/191 |
| 2446231 | 8/1980 | France . | |
| 22630 | of 1910 | United Kingdom . | |

*Primary Examiner*—Gary E. Elkins
*Attorney, Agent, or Firm*—Sheridan Ross & McIntosh

[57] ABSTRACT

A box with integral corner reinforcements and a method of making the same is described. The method comprises folding the box from a prescored sheet of material so as to leave a flap adjacent each corner. The flap is prescored and is pushed towards its hinged corner whereby it buckles into a curved shape. The end of the flap is secured by gluing or stapling so as to stabilize the curved shape. The curved shape considerably increases the stiffness and crush resistance of the whole box and may allow may more boxes to be stacked.

13 Claims, 4 Drawing Sheets

FIG. 1A
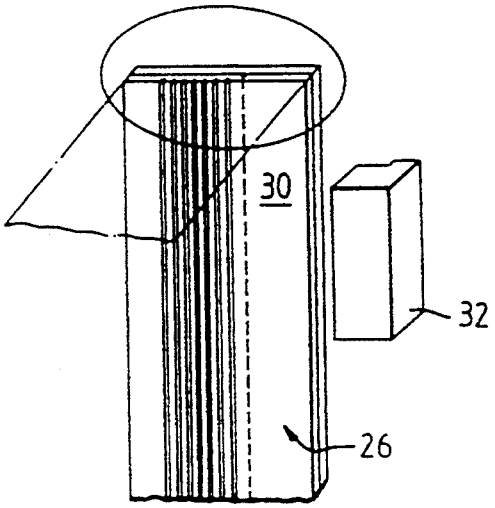
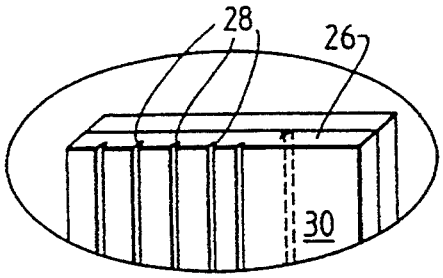
FIG. 1B
FIG. 2
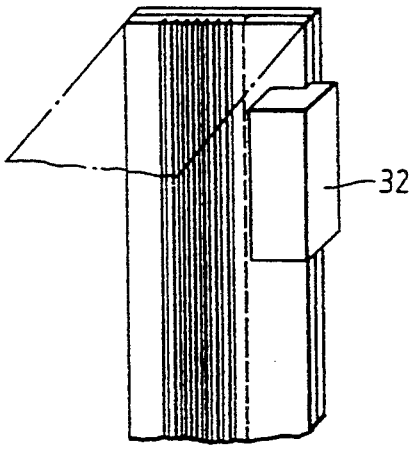
FIG. 3
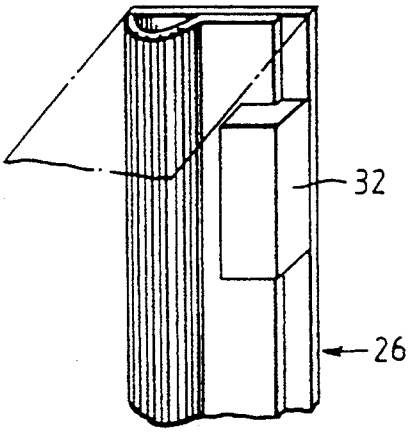
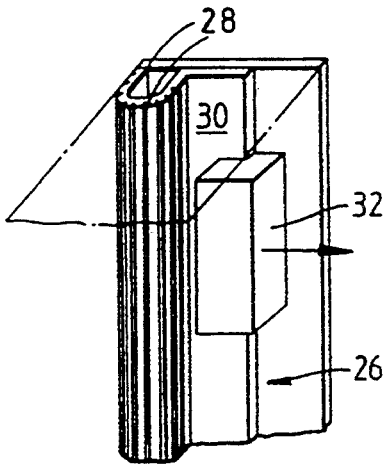
FIG. 4

BOX WITH INTEGRAL CORNER REINFORCEMENTS

This invention relates to boxes especially for the transport of food and in particular relates to a method of reinforcing the corners of such boxes.

Boxes for the transport of food such as fresh vegetables and fruits often comprise relatively shallow rectangular box portions having raised opposite end portions. FIG. 5 of the accompanying drawings illustrates one such general design. The raised end portions allow several boxes to be stacked one on top of the other without damage to the contents while access of air and the ability for visual inspection are not impaired with presentation being improved.

Many boxes of this type are produced from wood, but this material is not currently favoured for a number of reasons. Boxes of this type may also be produced from cardboard, a material whose strength is limited, and thus the height to which a stack of boxes can be made is limited if the lowermost boxes are not to be crushed.

The invention seeks to provide a method of reinforcing boxes which reduces or overcomes the above problem.

According to the present invention there is provided a method of making a box having a reinforced corner which comprises folding the box from a prescored sheet of material characterised in that adjacent each corner a flap of scored material is present which is deformed into an approximately cylindrical shape and secured whereby to provide reinforcement for the corner.

The invention will be described further, by way of example, with reference to the accompanying drawings, in which:

FIGS. 1 to 4 illustrate the production of the reinforced corner;

Figure 5:
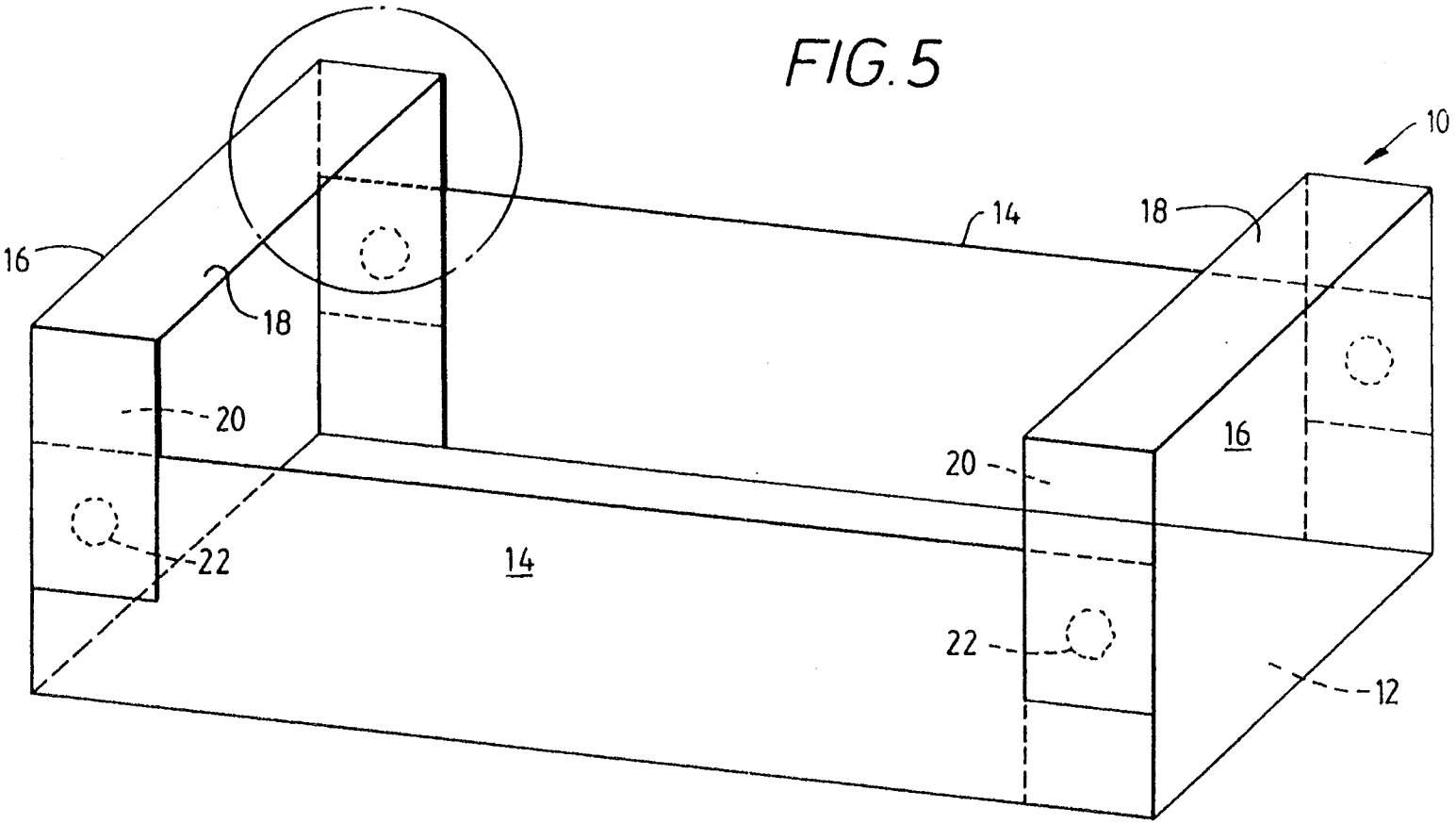
FIG. 5 is a diagramatic general perspective view of a suitable form of box.

Referring to the drawings, FIG. 5 illustrates a form of box often used for the transport of food, for example cauliflowers or peaches. The box, generally designated 10, comprises a base 12 generally rectangular in shape having longitudinal sides 14 and transverse ends 16. As illustrated the sides 14 are not as high as the ends 16 but this a matter of choice, since the sides 14 can be made to be as high as the ends 16. The shape illustrated allows air freely to circulate even when bores are stacked. As can be seen from FIG. 5 the ends 16 have overlapping top 18 and side 20 portions and the portions 20 are affixed to the sides 14 for example at sealing points 22. The "platforms" formed by the top portions 18 enable boxes to be stacked one on top of the other without damage to the contents.

Figure 6:
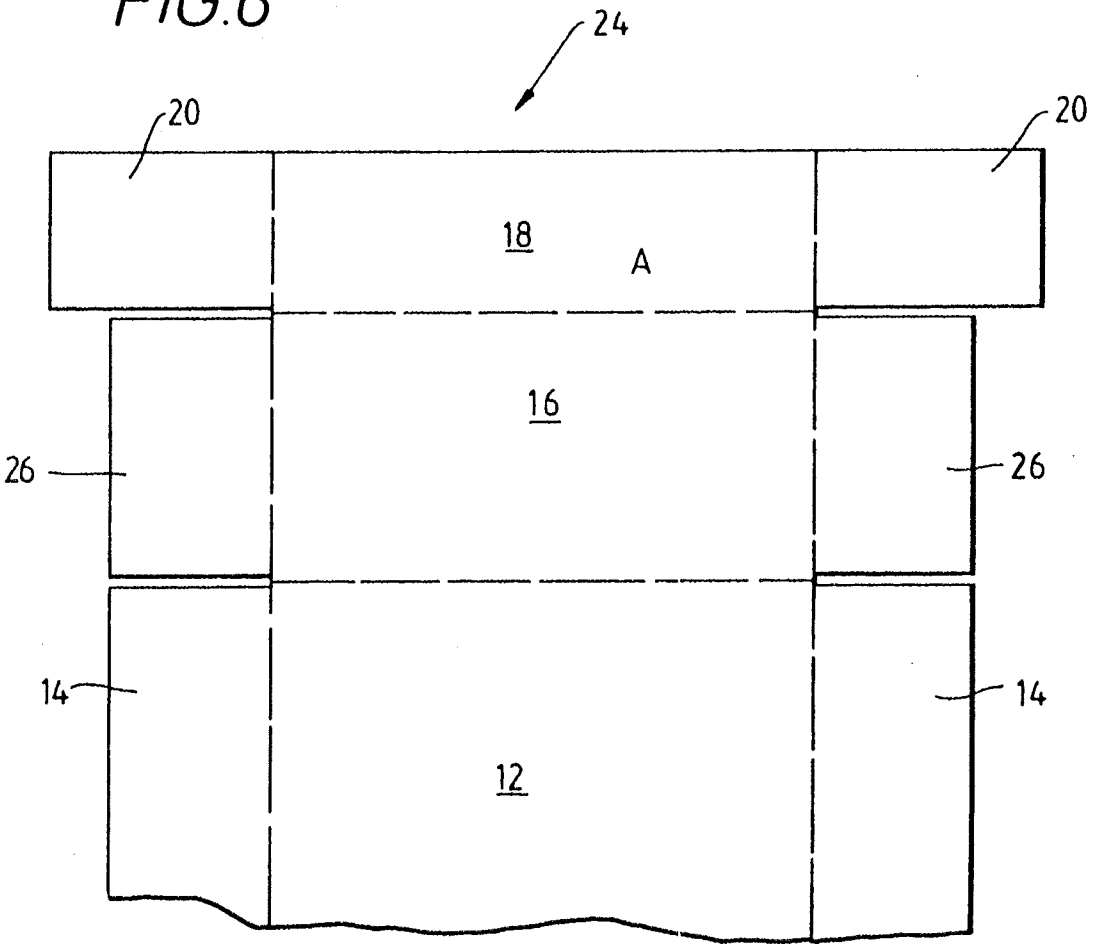
FIG. 6 is a view of a blank from which the box of FIG. 5 may be made.
Figure 7:
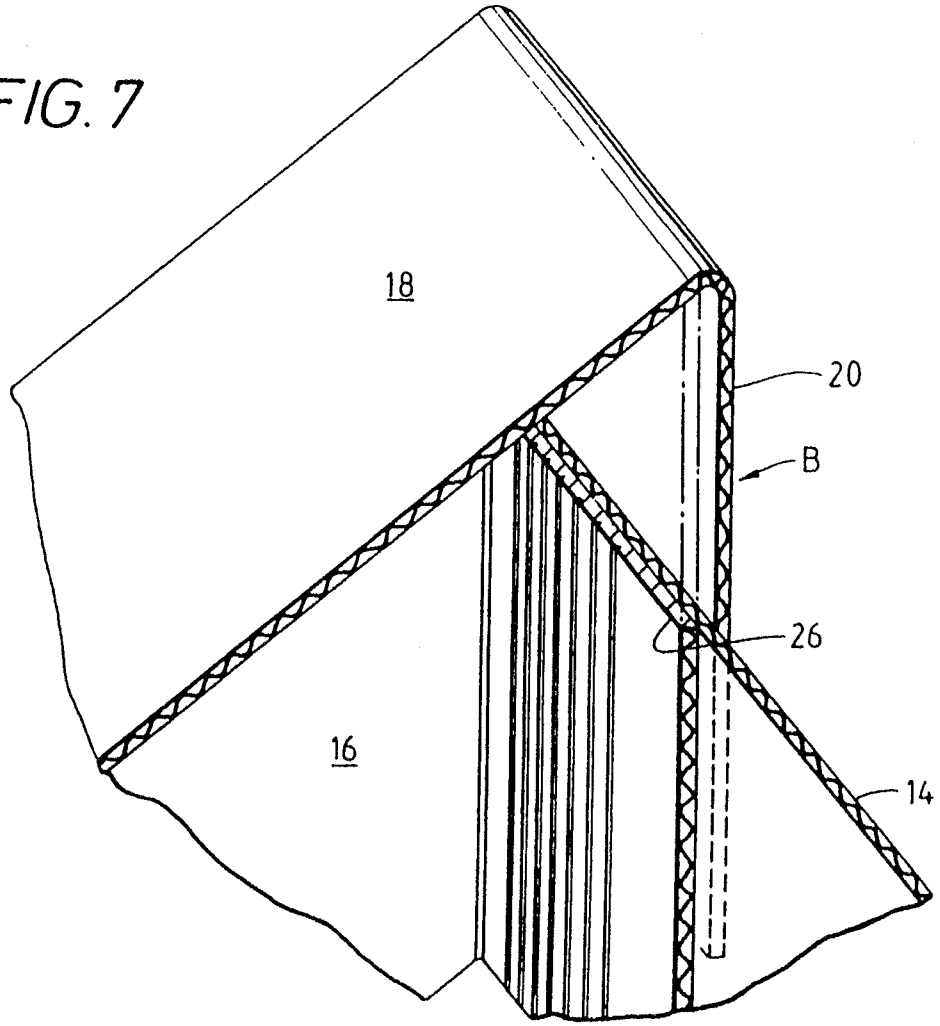
FIG. 7 is a detail of one corner of the box of the present invention.

The box 5 may be produced from a creased and cut blank 24 as illustrated in FIG. 6. As can be seen from FIG. 6 and 7 the blank has portions 26 which are in part supernumerary in that the box could still be formed if these portions were not there.

In accordance with the invention these portions 26 are formed (as can be seen better from FIGS. 1*a* and 1*b*) with a plurality of vertical score or crease lines 28 together with an uncreased portion 30. Once the box has been formed to the stage illustrated in FIG. 7, a pushing device 32 contacts the plain portion 30 of the flap 26 and pushes it to the left as illustrated in FIGS. 1 to 4 causing it to buckle progressively until it reaches the cylindrical shape illustrated in FIG. 4. At this point the plain portions 30, the flaps 20 and the sides 14 may be affixed e.g. glued, stapled or the like, to the remainder of the box therby stabilising the cylinder and securing the box, preferably in one operation. As can be seen from FIG. 4 the cylinder need not be geometrically exact in order to perform its function.

The net result is that each corner of the box is reinforced by the presence of the cylindrically folded flap 26 without using any additional material increasing the weight of the box since the flap 26 is produced from the same blank 24 which made the box as illustrated in FIG. 5. However, in use, the presence of the cylinder considerably increases the stiffness and crush resistance of the whole box and may allow many more boxes of produce to be stacked than was hitherto the case with boxes of the same material.

The method of the invention may be carried out on boxes made from most materials which can be creased and folded, for example cardboard, plastics material, and the like. However plastics materials are preferred for their generally superior strength, and the ability to employ ultra-sonic welding techniques which can be advantageous in terms of processing.

The cylinder, being formed from the flap 26 whose width is the same as the height of the box side 14, has a diameter dependant on the side height. Thus, where the height of the side is relatively small the cylinder will have a lower diameter and therefore a greater curveture. In these circumstances, corrugated cardboard may not have sufficient burst strength to be satisfactorily employed, whereas plastics materials, e.g. polyolefins, may be scored sufficiently densely (e. g. 5 mm intervals) to form the cylinder without bursting. Where the box height is greater the cylinder is of correspondingly larger diameter and, for instance, corrugate cardboard could be employed.

The invention further includes a box having reinforced corners comprising cylindrically folded flaps.

I claim:

1. A method of making a box having at least one reinforced corner which comprises folding the box from a pre-scored sheet of material characterized in that adjacent at least one corner a flap of scored material having closely spaced score lines is present, and deforming a multi-score line portion of said material into a single curved shape to provide reinforcement for the corner.

2. The method of claim 1, wherein the flap of scored material is secured by gluing.

3. The method of claim 1, wherein the flap of scored material is secured by stapling.

4. The method of claim 1, wherein each corner of the box is reinforced by the presence of a curved folded flap.

5. The method of claim 2, wherein each corner of the box is reinforced by the presence of a curved folded flap.

6. The method of claim 3, wherein each corner of the box is reinforced by the presence of a curved folded flap.

7. The method of claim 1, wherein the boxes are made from materials which can be creased and folded.

8. The method of claim 1, wherein said material is cardboard.

9. The method of claim 1, wherein said material is plastic.

10. The method of claim 1, wherein the material is a polyolefin.

11. The method of claim 1, wherein said score lines are spaced at about 5 millimeter intervals.

12. A box produced by the method as set forth in claim 11.

13. A box having integral corner reinforcements, said reinforcements formed by folding a prescored sheet of material having closely spaced score lines, and deforming a multi-score line portion of said material into a single curved shape.

* * * * *